US008960337B2

(12) United States Patent
Hall et al.

(10) Patent No.: US 8,960,337 B2
(45) Date of Patent: Feb. 24, 2015

(54) HIGH IMPACT RESISTANT TOOL WITH AN APEX WIDTH BETWEEN A FIRST AND SECOND TRANSITIONS

(75) Inventors: David R. Hall, Provo, UT (US); Ronald B. Crockett, Payson, UT (US); Casey Webb, Provo, UT (US); Michael Beazer, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 509 days.

(21) Appl. No.: 12/828,287

(22) Filed: Jun. 30, 2010

(65) Prior Publication Data

US 2010/0263939 A1 Oct. 21, 2010

Related U.S. Application Data

(63) Continuation-in-part of application No. 11/673,634, filed on Feb. 12, 2007, now Pat. No. 8,109,349, which is a continuation-in-part of application No. 11/668,254, filed on Jan. 29, 2007, now Pat. No. 7,353,893, which is a continuation-in-part of application No. 11/553,338, filed on Oct. 26, 2006, now Pat. No. 7,665,552.

(51) Int. Cl.

| | |
|---|---|
| ***E21B 10/46*** | (2006.01) |
| ***E21B 10/52*** | (2006.01) |
| ***E21B 10/567*** | (2006.01) |
| ***E21B 10/573*** | (2006.01) |

(52) U.S. Cl.

CPC ..... *E21B 10/5673* (2013.01); *E21B 10/5735* (2013.01); *E21B 10/5676* (2013.01)

USPC ..... 175/426; 175/425

(58) Field of Classification Search

USPC ..... 175/424, 434, 435, 426, 430

See application file for complete search history.

(56) References Cited

U.S. PATENT DOCUMENTS

| | | | |
|---|---|---|---|
| 2,004,315 | A | 6/1935 | Fean |
| 2,124,438 | A | 7/1938 | Struk |
| 3,254,392 | A | 6/1966 | Novkov |
| 3,746,396 | A | 7/1973 | Radd |
| 3,807,804 | A | 4/1974 | Kniff |
| 3,830,321 | A | 8/1974 | McKenry |
| 3,865,431 | A | 2/1975 | Crosby |
| 3,932,952 | A | 1/1976 | Helton |
| 3,945,681 | A | 3/1976 | White |
| 4,005,914 | A | 2/1977 | Newman |
| 4,006,936 | A | 2/1977 | Crabiel |
| 4,098,362 | A | 7/1978 | Bonnice |
| 4,109,737 | A | 8/1978 | Bovenkerk |

(Continued)

OTHER PUBLICATIONS

Office Action issued in counterpart U.S. Appl. No. 13/342,523; Dated Jul. 25, 2014 (9 pages).

*Primary Examiner* — Brad Harcourt

(74) *Attorney, Agent, or Firm* — Osha Liang LLP

(57) ABSTRACT

In one aspect of the present invention, a high impact resistant tool comprises a sintered polycrystalline diamond body bonded to a cemented metal carbide substrate at an interface, the body comprising a substantially pointed geometry with an apex, the apex comprising a curved surface that joins a leading side and a trailing side of the body at a first and second transitions respectively, an apex width between the first and second transitions is less than a third of a width of the substrate, and the body also comprises a body thickness from the apex to the interface greater than a third of the width of the substrate.

40 Claims, 15 Drawing Sheets

(56) References Cited

U.S. PATENT DOCUMENTS

| | | | | |
|---|---|---|---|---|
| 4,156,329 | A | 5/1979 | Daniels | |
| 4,199,035 | A | 4/1980 | Thompson | |
| 4,201,421 | A | 5/1980 | Den Besten | |
| 4,277,106 | A | 7/1981 | Sahley | |
| 4,333,902 | A | 6/1982 | Hara | |
| 4,333,986 | A | 6/1982 | Tsuji et al. | |
| 4,334,586 | A * | 6/1982 | Schumacher | 175/374 |
| 4,412,980 | A | 11/1983 | Tsuji | |
| 4,425,315 | A | 1/1984 | Tsuji | |
| 4,439,250 | A | 3/1984 | Acharya | |
| 4,465,221 | A | 8/1984 | Schmidt | |
| 4,484,644 | A | 11/1984 | Cook | |
| 4,489,986 | A | 12/1984 | Dziak | |
| 4,573,744 | A | 3/1986 | Clemmow | |
| 4,657,308 | A | 4/1987 | Clapham | |
| 4,678,237 | A | 7/1987 | Collin | |
| 4,682,987 | A | 7/1987 | Brady | |
| 4,688,856 | A | 8/1987 | Elfgen | |
| 4,725,098 | A | 2/1988 | Beach | |
| 4,729,603 | A | 3/1988 | Elfgen | |
| 4,765,686 | A | 8/1988 | Adams | |
| 4,765,687 | A | 8/1988 | Parrott | |
| 4,776,862 | A | 10/1988 | Wiand | |
| 4,880,154 | A | 11/1989 | Tank | |
| 4,932,723 | A | 6/1990 | Mills | |
| 4,940,288 | A | 7/1990 | Stiffler | |
| 4,944,559 | A | 7/1990 | Sionnet | |
| 4,951,762 | A | 8/1990 | Lundell | |
| 5,011,515 | A | 4/1991 | Frushour | |
| 5,092,310 | A | 3/1992 | Walen | |
| 5,112,165 | A | 5/1992 | Hedlund | |
| 5,141,289 | A | 8/1992 | Stiffler | |
| 5,154,245 | A | 10/1992 | Waldenstrom | |
| 5,172,777 | A * | 12/1992 | Siracki et al. | 175/374 |
| 5,186,892 | A | 2/1993 | Pope | |
| 5,235,961 | A | 8/1993 | McShannon | |
| 5,251,964 | A | 10/1993 | Ojanen | |
| 5,261,499 | A | 11/1993 | Grubb | |
| 5,319,855 | A | 6/1994 | Beevers | |
| 5,332,348 | A | 7/1994 | Iemelson | |
| 5,348,108 | A | 9/1994 | Scott et al. | |
| 5,417,475 | A | 5/1995 | Graham | |
| 5,447,208 | A | 9/1995 | Lund | |
| 5,535,839 | A | 7/1996 | Brady | |
| 5,542,993 | A | 8/1996 | Rabinkin | |
| 5,653,300 | A | 8/1997 | Lund | |
| 5,662,720 | A | 9/1997 | O'Tighearnaigh | |
| 5,738,698 | A | 4/1998 | Kapoor | |
| 5,823,632 | A | 10/1998 | Burkett | |
| 5,837,071 | A | 11/1998 | Anderson | |
| 5,845,547 | A | 12/1998 | Sollami | |
| 5,848,657 | A | 12/1998 | Flood | |
| 5,871,060 | A * | 2/1999 | Jensen et al. | 175/420.2 |
| 5,875,862 | A | 3/1999 | Jurewicz | |
| 5,890,552 | A | 4/1999 | Scott | |
| 5,934,542 | A | 8/1999 | Nakamura | |
| 5,935,718 | A | 8/1999 | Demo | |
| 5,944,129 | A | 8/1999 | Jenson | |
| 5,967,250 | A | 10/1999 | Lund | |
| 5,992,405 | A | 11/1999 | Sollami | |
| 6,000,483 | A | 12/1999 | Jurewicz | |
| 6,006,846 | A | 12/1999 | Tibbitts | |
| 6,019,434 | A | 2/2000 | Emmerich | |
| 6,044,920 | A | 4/2000 | Massa | |
| 6,051,079 | A | 4/2000 | Andersson | |
| 6,056,911 | A | 5/2000 | Griffin | |
| 6,065,552 | A | 5/2000 | Scott | |
| 6,068,072 | A | 5/2000 | Besson | |
| 6,113,195 | A | 9/2000 | Mercier | |
| 6,170,917 | B1 | 1/2001 | Heinrich | |
| 6,193,770 | B1 | 2/2001 | Sung | |
| 6,196,636 | B1 | 3/2001 | Mills | |
| 6,196,910 | B1 | 3/2001 | Johnson | |
| 6,199,956 | B1 | 3/2001 | Kammerer | |
| 6,216,805 | B1 | 4/2001 | Lays | |
| 6,220,375 | B1 * | 4/2001 | Butcher et al. | 175/428 |
| 6,270,165 | B1 | 8/2001 | Peay | |
| 6,332,503 | B1 | 12/2001 | Pessier et al. | |
| 6,341,823 | B1 | 1/2002 | Sollami | |
| 6,354,771 | B1 | 3/2002 | Sauschulle | |
| 6,364,420 | B1 | 4/2002 | Sollami | |
| 6,371,567 | B1 | 4/2002 | Sollami | |
| 6,375,272 | B1 | 4/2002 | Ojanen | |
| 6,419,278 | B1 | 7/2002 | Cunningham | |
| 6,460,637 | B1 | 10/2002 | Siracki | |
| 6,478,383 | B1 | 11/2002 | Ojanen | |
| 6,499,547 | B2 | 12/2002 | Scott | |
| 6,508,318 | B1 | 1/2003 | Linden | |
| 6,517,902 | B2 | 2/2003 | Drake | |
| 6,585,326 | B2 | 7/2003 | Sollami | |
| 6,596,225 | B1 | 7/2003 | Pope | |
| 6,601,662 | B2 | 8/2003 | Matthias | |
| 6,672,406 | B2 * | 1/2004 | Beuershausen | 175/57 |
| 6,685,273 | B1 | 2/2004 | Sollami | |
| 6,692,083 | B2 | 2/2004 | Latham | |
| 6,709,065 | B2 | 3/2004 | Peay | |
| 6,719,074 | B2 | 4/2004 | Tsuda | |
| 6,733,087 | B2 | 5/2004 | Hall | |
| 6,739,327 | B2 | 5/2004 | Sollami | |
| 6,758,530 | B2 | 7/2004 | Sollami | |
| 6,786,557 | B2 | 9/2004 | Montgomery, Jr. | |
| 6,824,225 | B2 | 11/2004 | Stiffler | |
| 6,851,758 | B2 | 2/2005 | Beach | |
| 6,854,810 | B2 | 2/2005 | Montgomery, Jr. | |
| 6,861,137 | B2 | 3/2005 | Griffin | |
| 6,889,890 | B2 | 5/2005 | Yamazaki | |
| 6,918,636 | B2 | 7/2005 | Dawood | |
| 6,966,611 | B1 | 11/2005 | Sollami | |
| 6,994,404 | B1 | 2/2006 | Sollami | |
| 7,204,560 | B2 | 4/2007 | Mercier | |
| 2001/0004946 | A1 | 6/2001 | Jensen | |
| 2002/0175555 | A1 | 11/2002 | Mercier | |
| 2003/0140350 | A1 | 7/2003 | Noro | |
| 2003/0209366 | A1 | 11/2003 | McAlvain | |
| 2003/0234280 | A1 | 12/2003 | Cadden | |
| 2004/0026983 | A1 | 2/2004 | McAlvain | |
| 2004/0065484 | A1 | 4/2004 | McAlvain | |
| 2004/0173384 | A1 * | 9/2004 | Yong et al. | 175/374 |
| 2005/0044800 | A1 | 3/2005 | Hall | |
| 2005/0159840 | A1 | 7/2005 | Lin | |
| 2005/0173966 | A1 | 8/2005 | Mouthaan | |
| 2006/0237236 | A1 | 10/2006 | Sreshta | |

* cited by examiner

HIGH IMPACT RESISTANT TOOL WITH AN APEX WIDTH BETWEEN A FIRST AND SECOND TRANSITIONS

CROSS REFERENCE TO RELATED APPLICATIONS

This application is a continuation-in-part of U.S. patent application Ser. No. 11/673,634, now U.S. Pat. No. 8,109,349, which was filed on Feb. 12, 2007 and entitled Thick Pointed Superhard Material, which is a continuation-in-part of U.S. patent application Ser. No. 11/668,254, now U.S. Pat. No. 7,353,893, filed Jan. 29, 2007, which is a continuation-in-part of U.S. patent application Ser. No. 11/553,338, now U.S. Pat. No. 7,665,552, filed Oct. 26, 2006. U.S. patent application Ser. No. 11/673,634 is herein incorporated by reference for all that it contains.

BACKGROUND OF THE INVENTION

The invention relates to a high impact resistant tool that may be used in machinery such as crushers, picks, grinding mills, roller cone bits, rotary fixed cutter bits, earth boring bits, percussion bits or impact bits, and drag bits. More particularly, the invention relates to inserts comprised of a carbide substrate with a non-planer interface and an abrasion resistant layer of super hard material affixed thereto using a high pressure high temperature press apparatus.

U.S. Pat. No. 5,544,713 by Dennis, which is herein incorporated by reference for all that it contains, discloses a cutting element which has a metal carbide stud having a conic tip formed with a reduced diameter hemispherical outer tip end portion of said metal carbide stud. The tip is shaped as a cone and is rounded at the tip portion. This rounded portion has a diameter which is 35-60% of the diameter of the insert.

U.S. Pat. No. 6,408,959 by Bertagnolli et al., which is herein incorporated by reference for all that it contains, discloses a cutting element, insert or compact which is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al, which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

U.S. Pat. No. 4,109,737 by Bovenkerk which is herein incorporated by reference for all that it contains, discloses a rotary bit for rock drilling comprising a plurality of cutting elements mounted by interence-fit in recesses in the crown of the drill bit. Each cutting element comprises an elongated pin with a thin layer of polycrystalline diamond bonded to the free end of the pin.

U.S. Patent Application Ser. No. 2001/0004946 by Jensen, although now abandoned, is herein incorporated by reference for all that it discloses. Jensen teaches that a cutting element or insert with improved wear characteristics while maximizing the manufacturability and cost effectiveness of the insert.

This insert employs a superabrasive diamond layer of increased depth and by making use of a diamond layer surface that is generally convex.

BRIEF SUMMARY OF THE INVENTION

In one aspect of the present invention, a high impact resistant tool comprises a sintered polycrystalline diamond body bonded to a cemented metal carbide substrate at an interface. The body comprises a substantially pointed geometry with an apex, and the apex comprises a curved surface that joins a leading side and a trailing side of the body at a first and second transitions respectively. An apex width between the first and second transitions is less than a third of a width of the substrate, and the body also comprises a body thickness from the apex to the interface greater than a third of the width of the substrate.

The body thickness may be measured along a central axis of the tool. The tool central axis may intersect the apex and the interface. The apex width may be a quarter or less than the width of the substrate, and the body thickness may be less than ¾ the width of the substrate. The body thickness may be greater than a substrate thickness along the central axis. The diamond body may comprise a volume between 75 and 150 percent of a substrate volume. The curved surface may comprise a radius of curvature between 0.050 and 0.110 inches. The curved surface may comprise a plurality of curvatures, or a non-circular curvature.

The diamond volume contained by the curved surface may comprise less than five percent of catalyzing material by volume, and at least 95 percent of the void between polycrystalline diamond grains may comprise a catalyzing material. In some embodiments, at least 99 percent of the voids between polycrystalline diamond grains comprise a catalyzing material.

The diamond body may comprise a substantially conical shape, a substantially pyramidal shape, or a substantially chisel shape. The body may comprise a side which forms a 35 to 55 degree angle with the central axis of the tool. In some embodiments, the side may form an angle substantially 45 degrees. The body may comprise a substantially convex side or a substantially concave side.

The interface at the substrate may comprise a tapered surface starting from a cylindrical rim of the substrate and ending at an elevated flatted central region formed in the substrate.

In some embodiments, the tool may comprise the characteristic of withstanding impact greater than 200 Joules.

In some embodiments, the substrate may be attached to a drill bit, a percussion drill bit, a roller cone bit, a fixed bladed bit, a milling machine, an indenter, a mining pick, an asphalt pick, a cone crusher, a vertical impact mill, a hammer mill, a jaw crusher, an asphalt bit, a chisel, a trenching machine, or combinations thereof.

DETAILED DESCRIPTION OF THE INVENTION AND THE PREFERRED EMBODIMENT

Figure 1:
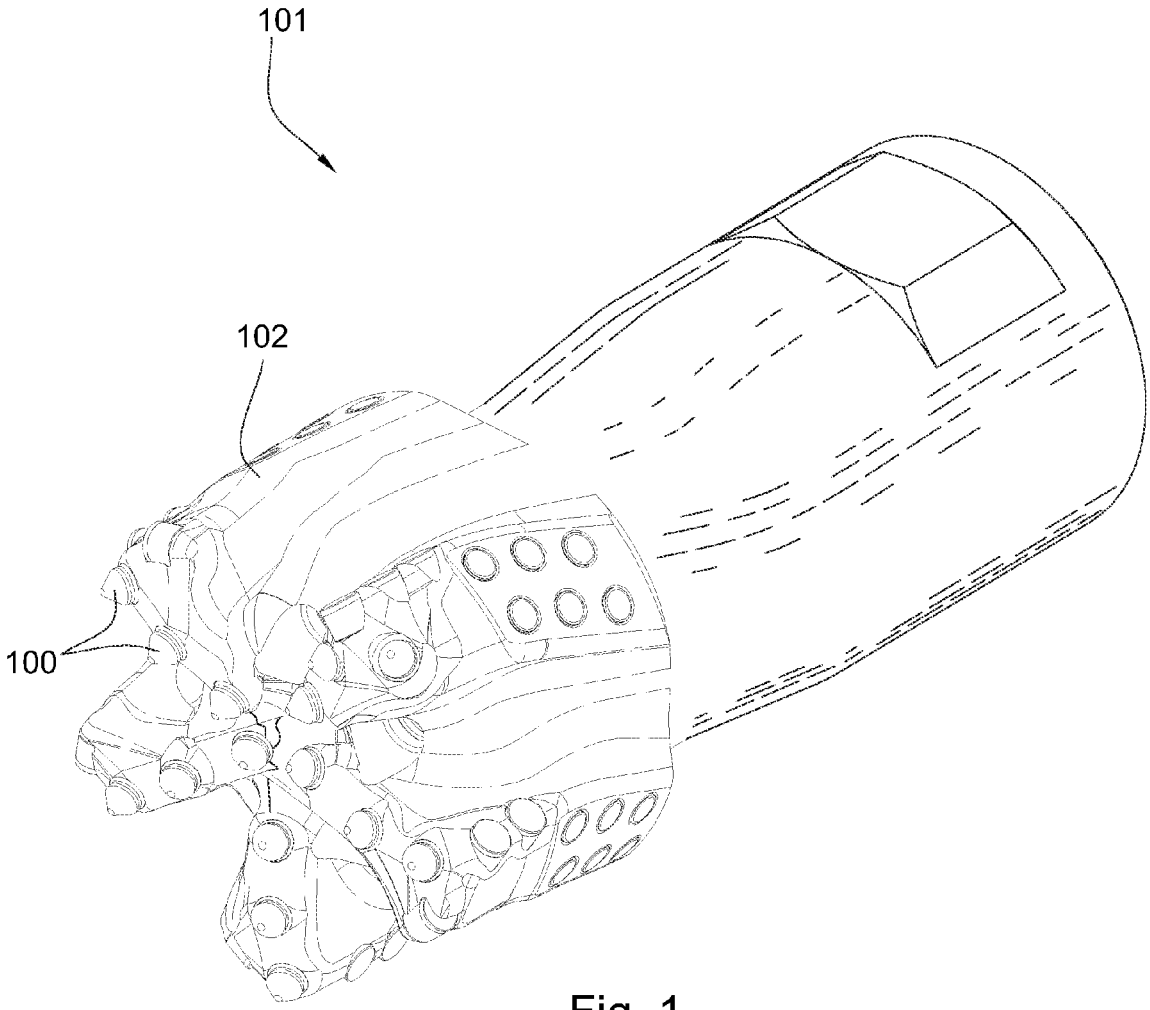
FIG. 1 is a perspective view of an embodiment of a drill bit.

Referring now to the figures, FIG. 1 discloses an embodiment of a fixed bladed drill bit 101. Drill bit 101 comprises a plurality of high impact tools 100. High impact tools 100 may be attached to a body 102 of the drill bit 101 by brazing, press fit, or other mechanical or material method.

Figure 2:
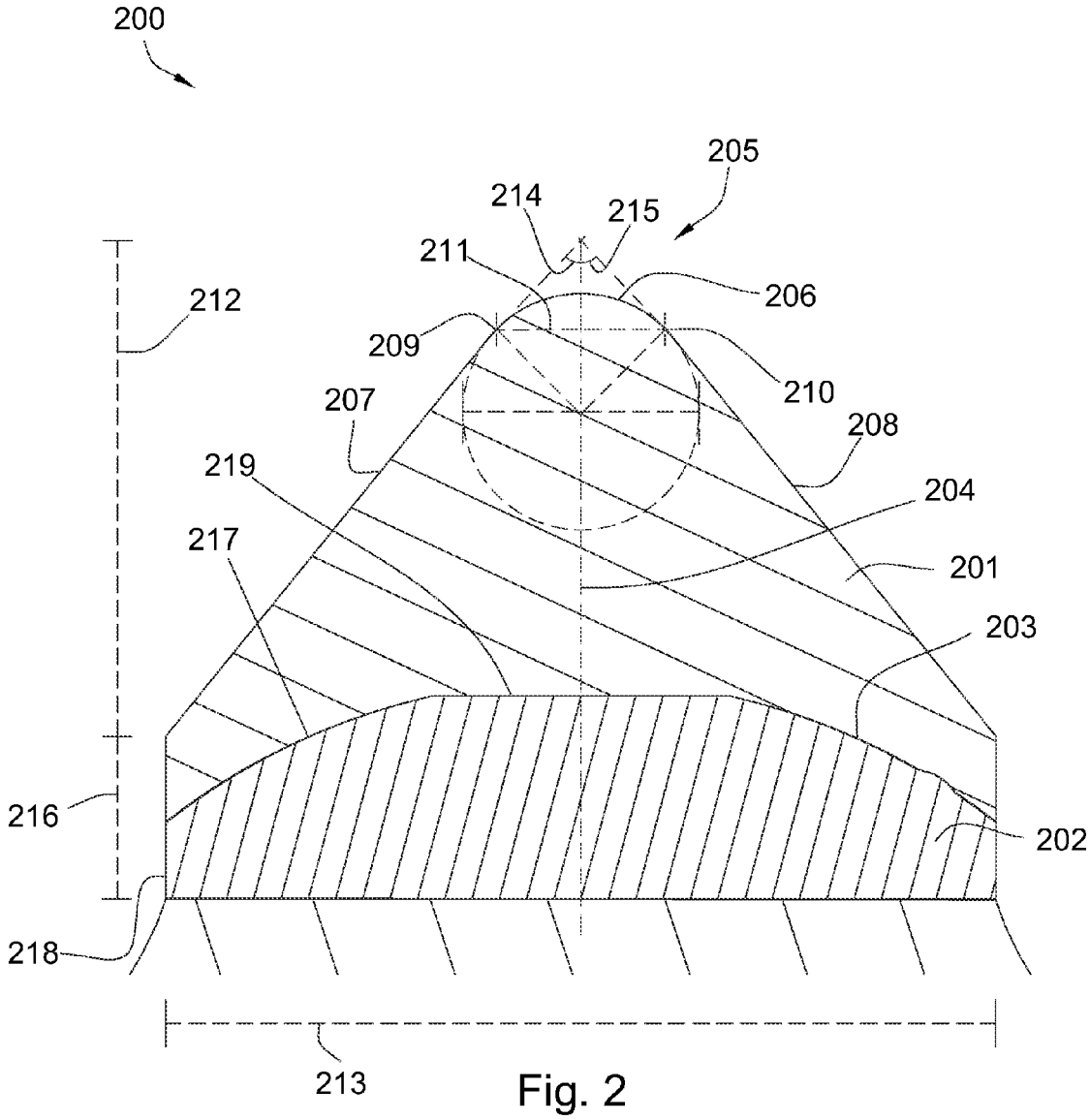
FIG. 2 is a cross-sectional view of an embodiment of a high impact tool.

FIG. 2 discloses an embodiment of a high impact tool 200, comprising a sintered polycrystalline diamond body 201 and a cemented metal carbide substrate 202 bonded at an interface 203. A central axis 204 may intersect the substrate 202 and an apex 205 of the diamond body 201. The polycrystalline diamond body 201 and the cemented metal carbide substrate 202 may be processed together in a high-pressure, high temperature press.

The sintered polycrystalline diamond body 201 may comprise substantially pointed geometry. The apex 205 comprises a curved surface 206 that joins a leading side 207 and a trailing side 208 at a first transition 209 and a second transition 210. The apex 205 comprises an apex width 211 between the first transition 209 and the second transition 210. The diamond body 201 comprises a thickness 212 from the apex 205 to the interface 203. The diamond body thickness 212 may be greater than one third of a width 213 of the substrate 202. The apex width 211 may be less than one third the width 213 of the substrate 202, and in some embodiments, the apex width may be less than one quarter of the substrate width.

The leading side 207 and the trailing side 208 of the diamond body 201 may form angles 214 and 215 with the central axis 204. Angles 214 and 215 may be between 35 and 55 degrees, and in some embodiments may be substantially 45 degrees. Angles 214 and 215 may be equal, or in some embodiments, may be substantially unequal. In some embodiments, the leading side and trailing side comprise linear geometry. In other embodiments, the leading and trailing sides may be concave, convex, or combinations thereof.

The curved surface 206 may comprise a radius of curvature between 0.050 inches and 0.110 inches. In some embodiments, the apex width 211 may be substantially less than twice the radius of curvature. The curved surface may comprise a variable radius of curvature, a curve defined by a parametric spline, a parabolic curve, an elliptical curve, a catenary curve, other conic shapes, linear portions, or combinations thereof.

In some embodiments, a volume contained by the curved surface 206 may comprise less than 5% of catalyzing material by volume, and at least 95% of the void between polycrystalline diamond grains may comprise catalyzing material. In some embodiments, at least 99% of the void between diamond grains comprises catalyzing material.

The body thickness 212 may be measured along the central axis 204 of the tool. The central axis 212 may intersect the apex 205 of the diamond body and the interface 203 between the diamond body and the cemented metal carbide substrate. The body thickness 212 may be greater than a substrate thickness 216 as measured along the central axis 204. The volume of the diamond body portion may be 75% to 150% of the volume of the cemented metal carbide substrate portion.

The interface 203 may comprise a tapered portion 217 starting at a cylindrical portion 218 and ending at an elevated central flatted region 219. It is believed that the increased bonding surface area resulting from this geometry provides higher total bond strength.

High impact tool 200 may be used in industrial applications such as drill bits, percussion drill bits, roller cone bits, fixed bladed bits, milling machines, indenters, mining picks, asphalt picks, cone crushers, vertical impact mills, hammer mills, jaw crushers, asphalt bits, chisels, trenching machines, or combinations thereof.

In some embodiments, the high impact tool 200 may comprise the characteristic of withstanding impact of greater than 200 Joules in a drop test.

Figure 3A:
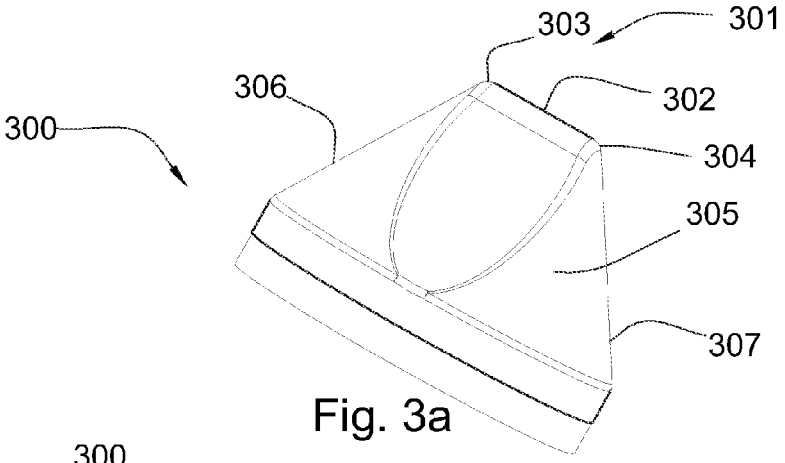
FIG. 3*a* is a perspective view of another embodiment of a high impact tool.
Figure 3B:
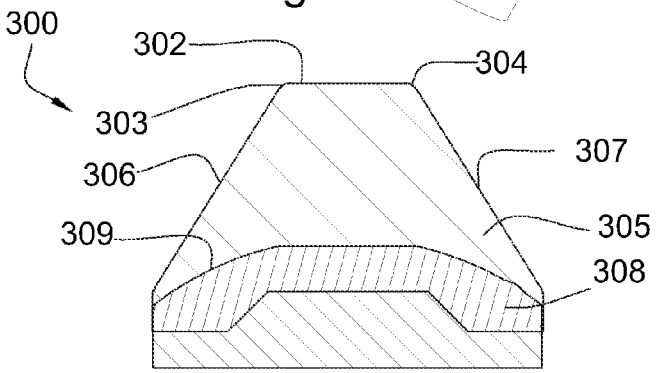
FIG. 3*b* is a cross-sectional view of another embodiment of high impact tool.
Figure 3C:
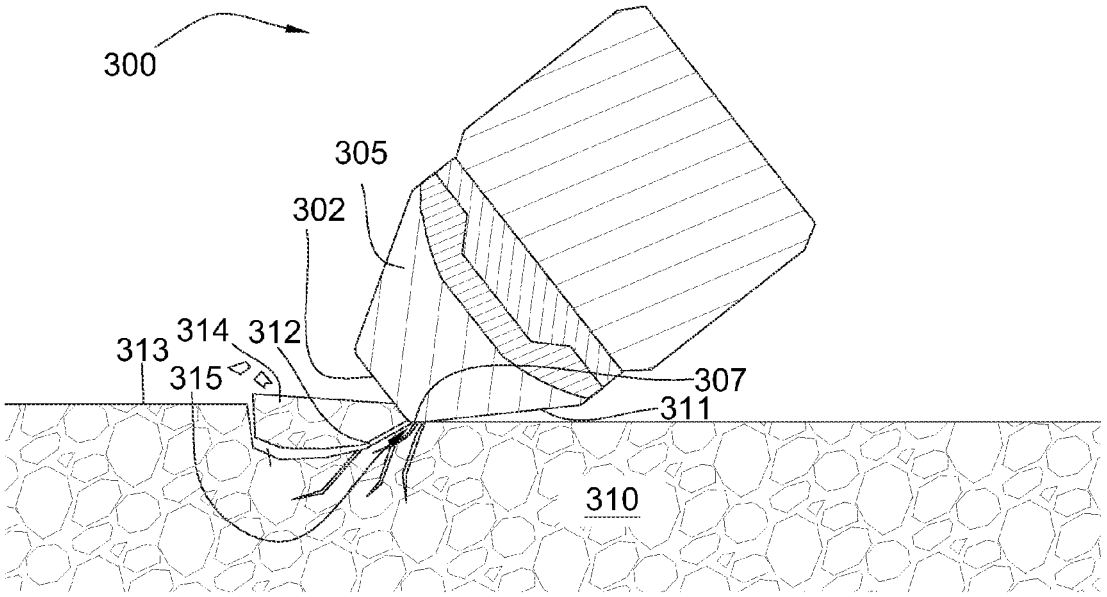
FIG. 3*c* is a cross-sectional view of another embodiment of a high impact tool.

FIG. 3*a* discloses another embodiment of a high impact tool 300. In this embodiment, an apex 301 comprises a linear portion 302 and two curved areas 303 and 304. A diamond body portion 305 comprises a leading side 306 and a trailing side 307. Curved areas 303 and 304 join the linear portion 302 to the leading side 306 and trailing side 307. FIG. 3*b* shows a cross sectional view of high impact tool 300. Curved areas 303 and 304 tangentially join linear portion 302 to leading side 306 and trailing side 307. A cemented metal carbide substrate 308 joins diamond body portion 305 at a non-planer interface 309. FIG. 3*c* shows the high impact tool 300 in use degrading a formation 310. An apex 311 of the high impact tool 300 impinges the formation 310, causing cracks 312 to propagate. Cracks 312 may propagate to a surface 313 of the formation 310, allowing chips 314 to break free. A contact area 315 between the apex 311 and the formation 310 comprises a surface area sufficiently small to create high levels of stress in the formation, thereby causing the formation to fail. Linear portion 302 and trailing side 307 support the high compressive loads in the diamond body 305 and allow the high impact tool 300 to apply high loads to the formation without failure.

Figure 4A:
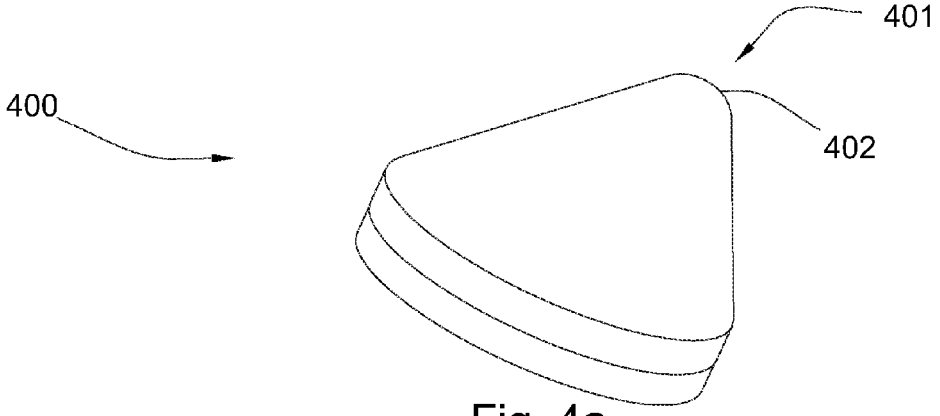
FIG. 4*a* is a perspective view of another embodiment of a high impact tool.
Figure 4B:
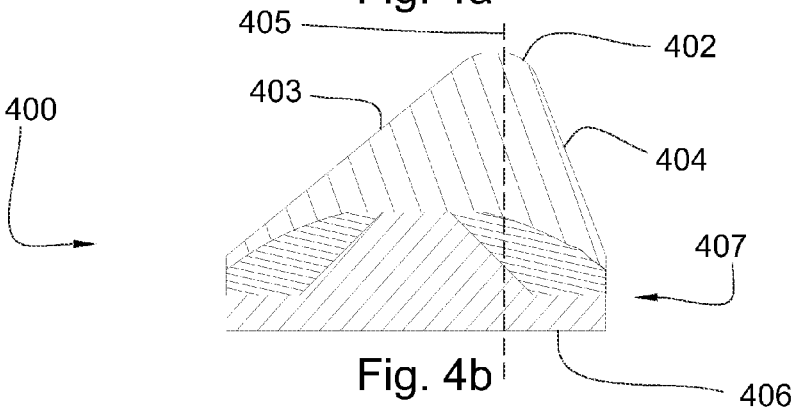
FIG. 4*b* is a cross-sectional view of another embodiment of high impact tool.
Figure 4C:
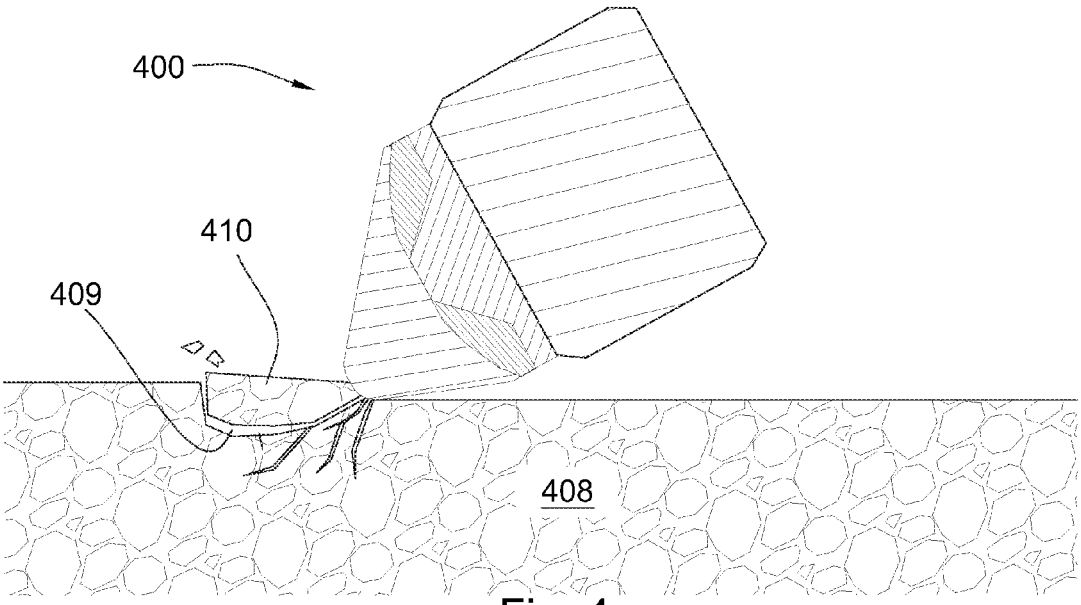
FIG. 4*c* is a cross-sectional view of another embodiment of a high impact tool.

FIG. 4*a* discloses another embodiment of a high impact tool 400. In this embodiment, a high impact tool 400 comprises an apex 401 with a curved surface 402. Curved surface 402 may comprise a radius of curvature from 0.050 to 0.110 inches, a variable radius, conic sections, or combinations thereof. FIG. 4*b* shows a cross section of the high impact tool 400. Curved surface 402 tangentially joins a leading side 403 and a trailing side 404. In this embodiment, leading side 403 and trailing side 404 form different angles with respect to an axis 405 normal to a surface 406 of a cemented metal carbide substrate 407 and passing through apex 401. FIG. 4*c* shows the high impact tool 400 impinging a formation 408, causing cracks 409 to propagate and chips 410 to break free from the formation.

Figure 5A:
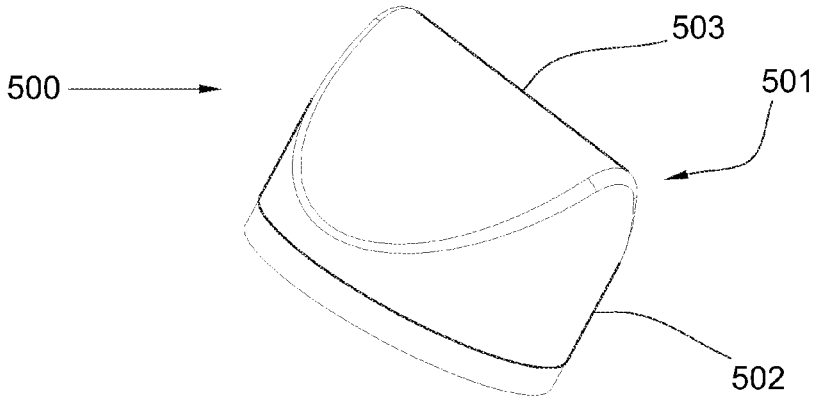
FIG. 5*a* is a perspective view of another embodiment of a high impact tool.
Figure 5B:
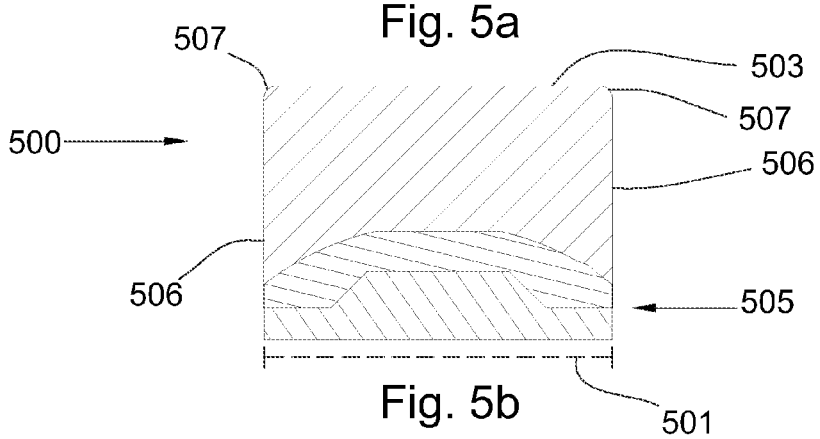
FIG. 5*b* is a cross-sectional view of another embodiment of high impact tool.
Figure 5C:
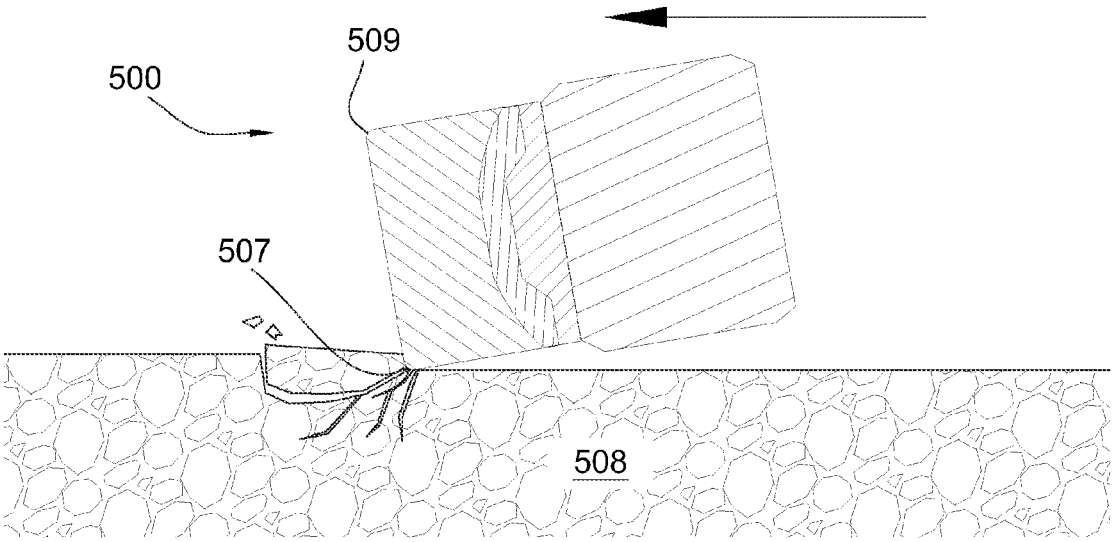
FIG. 5*c* is a cross-sectional view of another embodiment of a high impact tool.

FIG. 5*a* discloses another embodiment of a high impact tool 500 that comprises chisel-like geometry. An apex 501 is disposed intermediate a side wall 502 and a linear portion 503 of the tool 500. FIG. 5*b* discloses a cross sectional view of the tool 500. A linear portion 503 substantially equal to a diameter 501 of a cemented metal carbide substrate 505 joins to side walls 506 of the tool 500 at rounded apexes 507 in a tangential manner. FIG. 5*c* shows the high impact tool 500 impinging a formation 508, causing cracks to propagate through the formation allowing chips to break free. After apex 507 becomes worn from abrasion and impact, tool 500 can be rotated 180 degrees to allow unworn apex 509 to impinge the formation, effectively doubling the life of the tool.

Figure 6A:
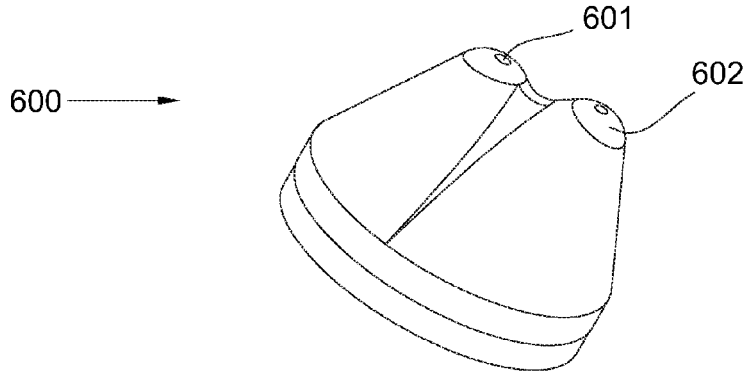
FIG. 6*a* is a perspective view of another embodiment of a high impact tool.
Figure 6B:
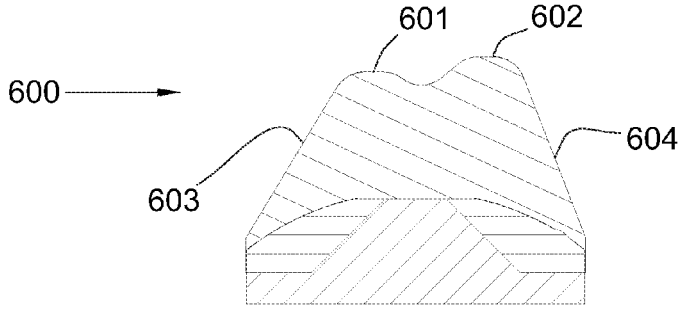
FIG. 6*b* is a cross-sectional view of another embodiment of high impact tool.
Figure 6C:
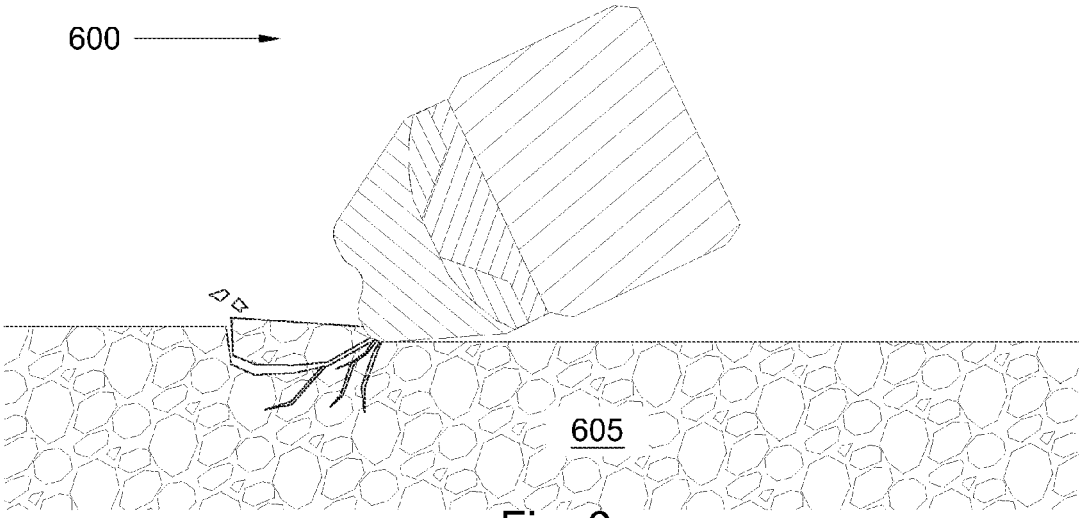
FIG. 6*c* is a cross-sectional view of another embodiment of a high impact tool.

FIG. 6*a* discloses a high impact tool 600 comprising conical geometry and two apexes 601 and 602. FIG. 6*b* shows a cross sectional view of the high impact tool 600. The conical geometry comprises a leading side 603 and a trailing side 604 tangentially joined to apexes 601 and 602. Apexes 601 and 602 may comprise equal or unequal radii of curvature. In FIG. 6*c*, the high impact tool 600 is shown impinging a formation 605.

Figure 7A:
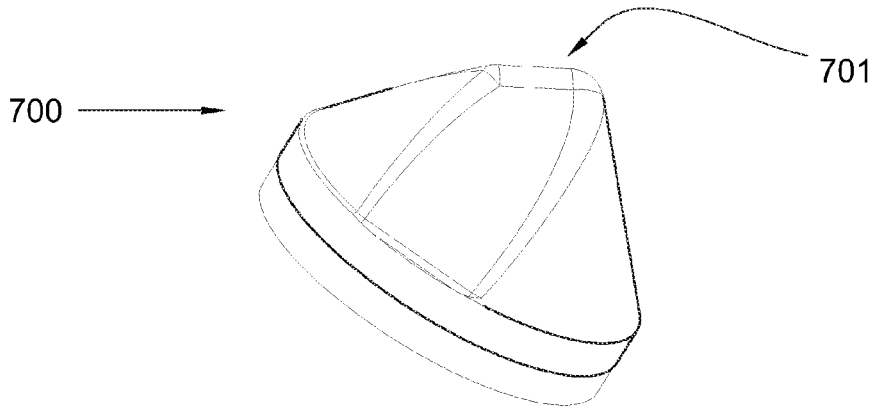
FIG. 7*a* is a perspective view of another embodiment of a high impact tool.
Figure 7B:
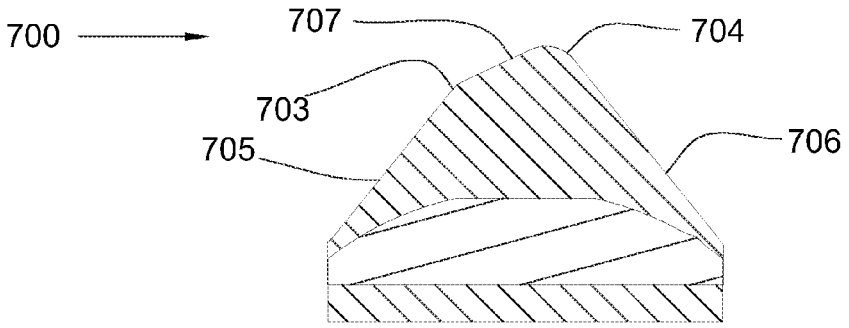
FIG. 7*b* is a cross-sectional view of another embodiment of high impact tool.
Figure 7C:
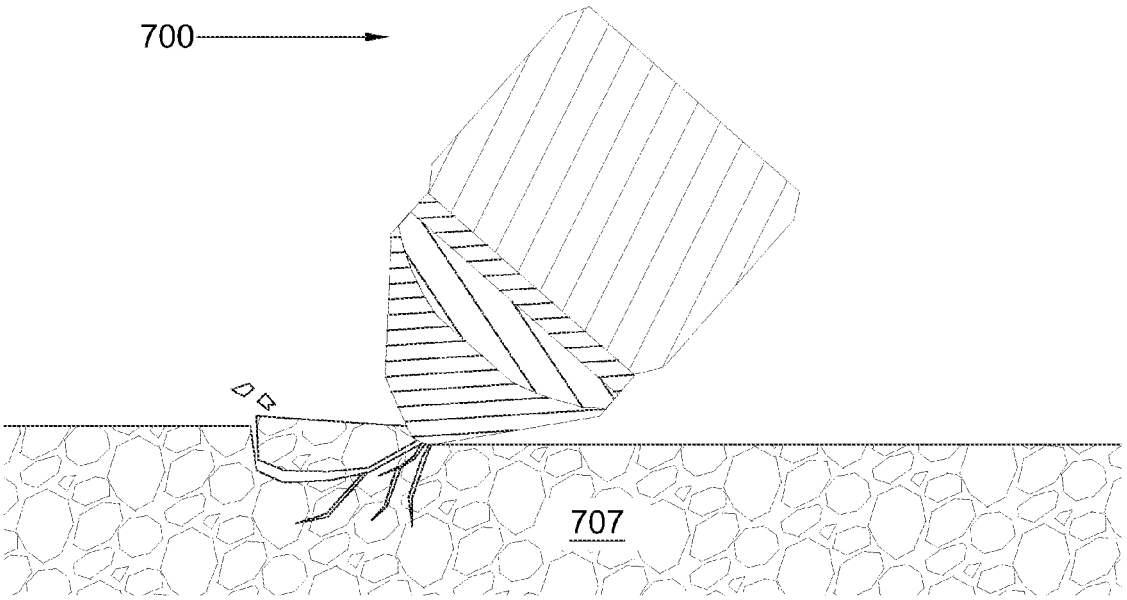
FIG. 7*c* is a cross-sectional view of another embodiment of a high impact tool.

FIG. 7*a* discloses a high impact tool 700 comprising an asymmetrical apex 701. FIG. 7*b* shows a cross-sectional view of the high impact tool 700. An angled linear portion 702 is disposed intermediate a first transition 703 and a second transition 704. First and second transitions tangentially join angled linear portion 702 to a leading side 705 and a trailing side 706. FIG. 7*c* shows high impact tool 700 impinging a formation 707.

Figure 8A:
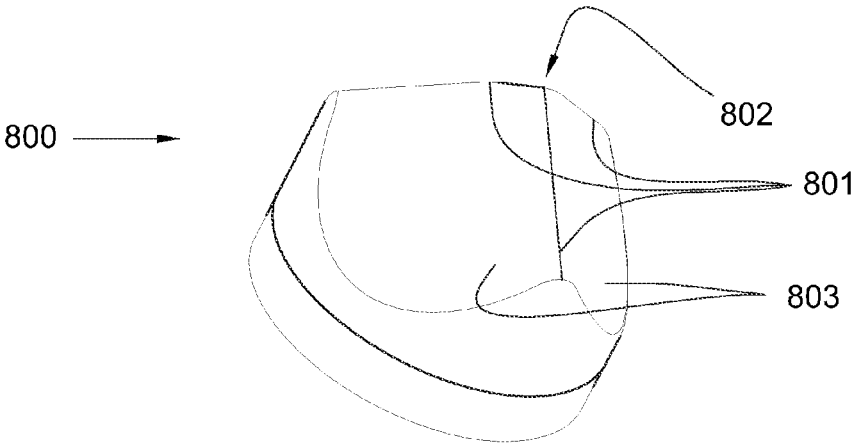
FIG. 8*a* is a perspective view of another embodiment of a high impact tool.
Figure 8B:
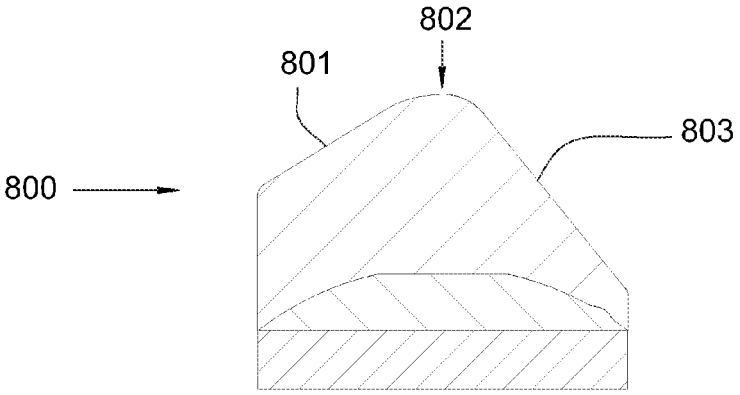
FIG. 8*b* is a cross-sectional view of another embodiment of high impact tool.
Figure 8C:
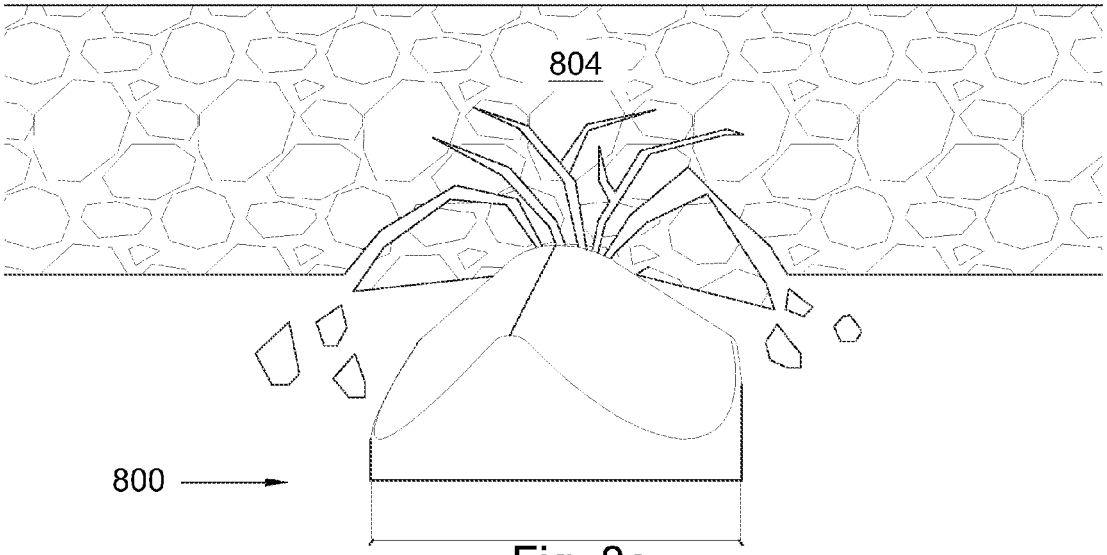
FIG. 8*c* is a cross-sectional view of another embodiment of a high impact tool.

FIG. 8*a* discloses a high impact tool 800 comprising pyramidal geometry with three edges 801 which converge at an apex 802. High impact tool 800 comprises planer faces 803 intermediate each edge 801. FIG. 8*b* shows a cross-sectional view of the high impact tool 800. The cross sectional plane passes through an edge 801, the apex 802, and a planer face 803. FIG. 8*c* discloses the high impact tool 800 impinging a formation 804. Pyramidal geometry may help to penetrate the formation and cause the formation to fail in tension, rather than in compression or shear.

Figure 9:
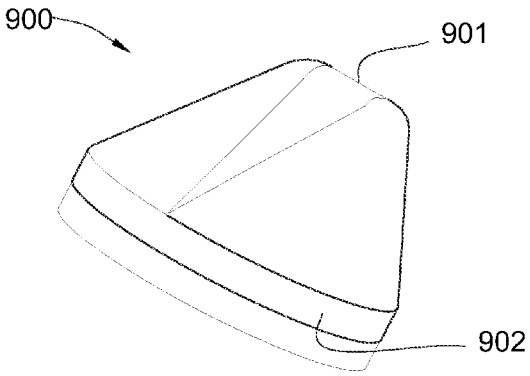
FIG. 9 is a perspective view of another embodiment of a high impact tool.

FIG. 9 discloses another embodiment of a high impact tool 900. In this embodiment, a linear portion 901 is offset from a center of a carbide substrate 902.

Figure 10:
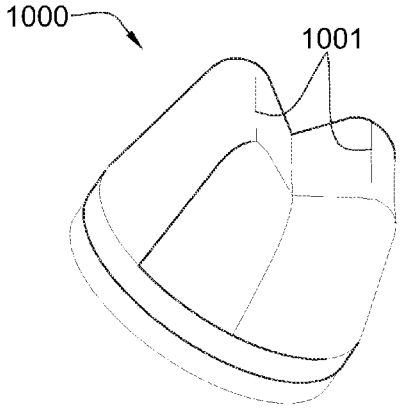
FIG. 10 is a perspective view of another embodiment of a high impact tool.

FIG. 10 discloses another embodiment of a high impact tool 1000 that comprises two linear portions 1001.

Figure 11:
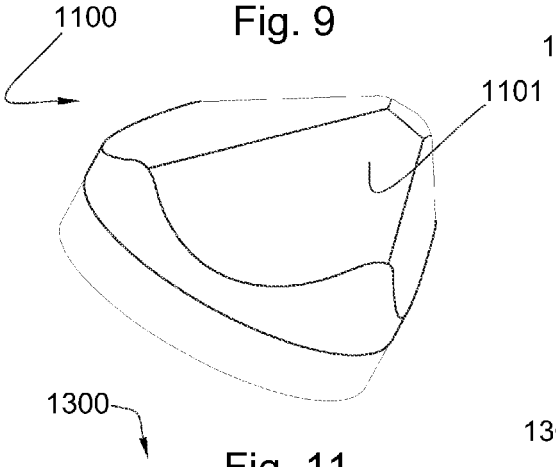
FIG. 11 is a perspective view of another embodiment of a high impact tool.

FIG. 11 discloses another embodiment of a high impact tool 1100 comprising asymmetrical polygonal geometry 1101.

Figure 12:
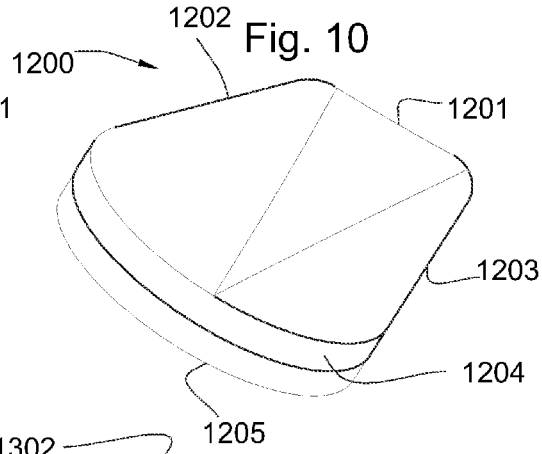
FIG. 12 is a perspective view of another embodiment of a high impact tool.

FIG. 12 discloses another embodiment of a high impact tool 1200. In this embodiment, high impact tool 1200 comprises a linear portion 1201 intermediate an angled side 1202 and a side 1203 vertical with respect to a surface 1205 of a cemented metal carbide substrate 1204.

Figure 13:
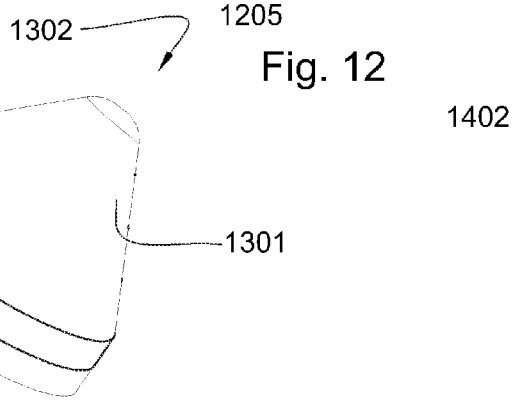
FIG. 13 is a perspective view of another embodiment of a high impact tool.

FIG. 13 discloses another embodiment of a high impact tool 1300. High impact tool 1300 comprises offset conical geometry 1301 and an apex 1302.

Figure 14:
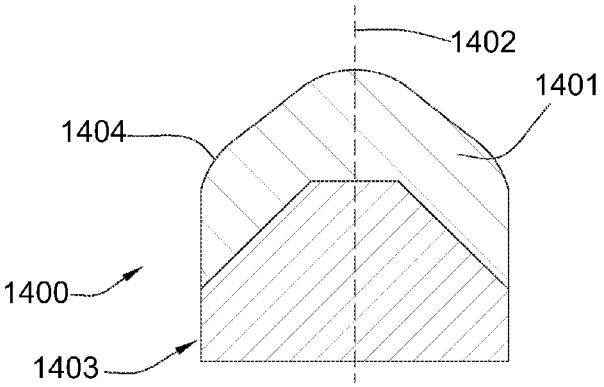
FIG. 14 is a cross-sectional view of another embodiment of a high impact tool.

FIG. 14 discloses a high impact tool 1400 with sintered polycrystalline diamond body 1401 that is thick along the central axis 1402 as well as adjacent the tool's periphery 1403. Further, the edge of the tool comprises a curvature 1404 with a 0.050 to 0.120 radius of curvature (measured in a plane that is common to the tool's central axis).

Figure 15:
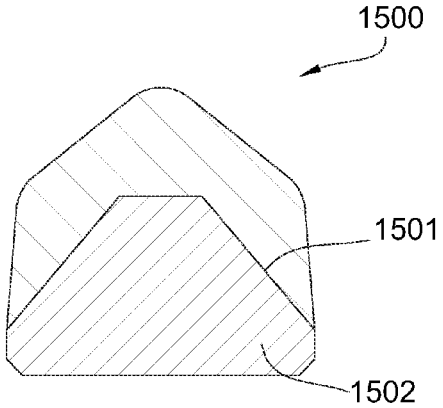
FIG. 15 is a cross-sectional view of another embodiment of a high impact tool.

FIG. 15 discloses a high impact tool 1500 with a steeper taper 1501 on its cemented carbide substrate 1502.

Figure 16:
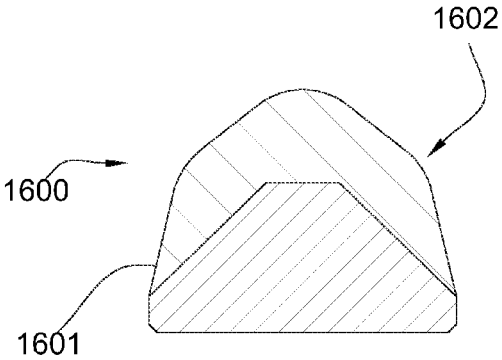
FIG. 16 is a cross-sectional view of another embodiment of a high impact tool.

FIG. 16 discloses a high impact tool 1600 with thick diamond at its periphery. Also the tool's side wall 1601 tapers to the tool's edge 1602.

Figure 17:
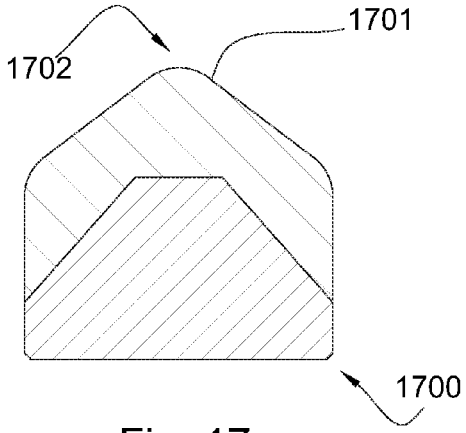
FIG. 17 is a cross-sectional view of another embodiment of a high impact tool.

FIG. 17 discloses a tool 1700 similar to the tool 1400 of FIG. 14, but with a sharper radius 1701 of curvature at the tool's apex 1702.

Figure 18:
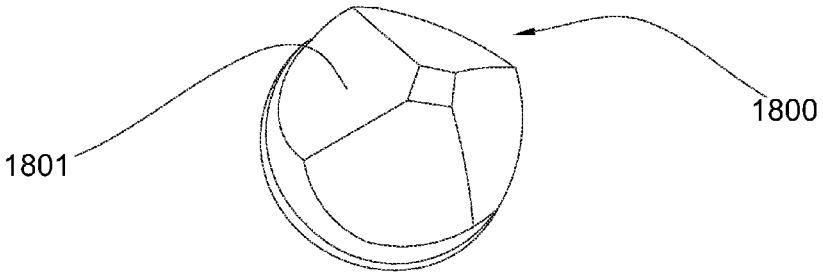
FIG. 18 is a perspective view of an embodiment of a high impact tool's substrate.

FIG. 18 discloses a carbide substrate 1800 without sintered polycrystalline diamond for illustrative purposes. In this embodiment, the substrate comprises flats 1801, although in the preferred embodiment, the substrate comprises no flats, but forms a continuous curvature.

Figure 19:
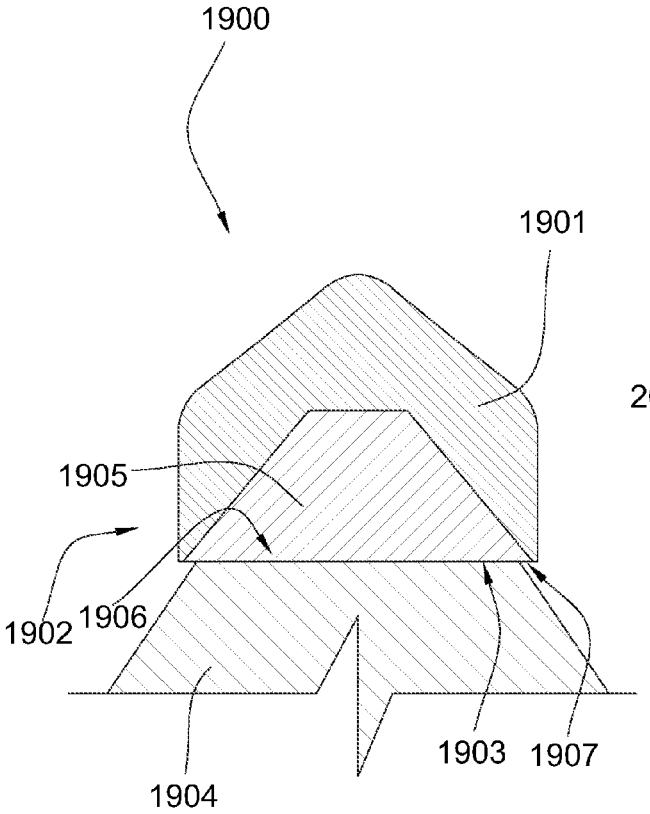
FIG. 19 is a cross-sectional view of another embodiment of a high impact tool.
Figure 20:
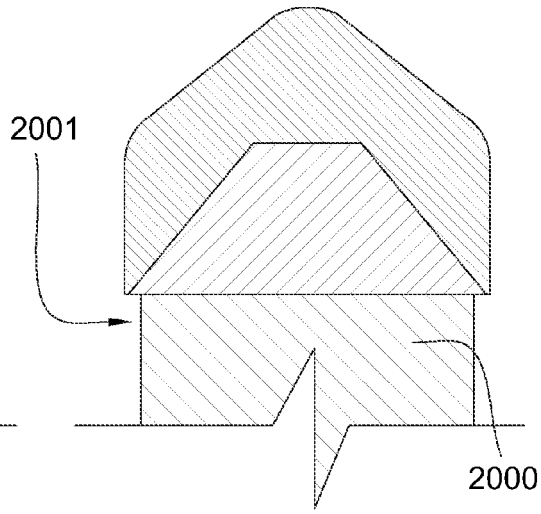
FIG. 20 is a cross-sectional view of another embodiment of a high impact tool.

FIG. 19 discloses a high impact tool 1900 that comprises a sintered polycrystalline diamond body 1901 along the entire periphery 1902 of the tool. The diamond body contacts the underside 1903 of the tool which is bonded to a support 1904. The support may be a tapered bolster on a road milling or mining pick. The cemented metal carbide substrate 1905 of the high impact tool may be brazed to the support. The underside of the high impact tool is slightly wider than the support's brazing surface 1906. It is believed that a slightly larger underside yields better results in most applications. While the cross sectional differences of FIG. 19 disclose a clearly visible overhang 1907, preferably the overhang is small enough that the braze material hides the overhang. In some embodiments, the overhang may only be a few thousandths of an inch. FIG. 20 discloses a support 2000 that has a substantially uniform diameter 2001 as opposed to the tapered support 1904 of FIG. 19.

Figure 21:
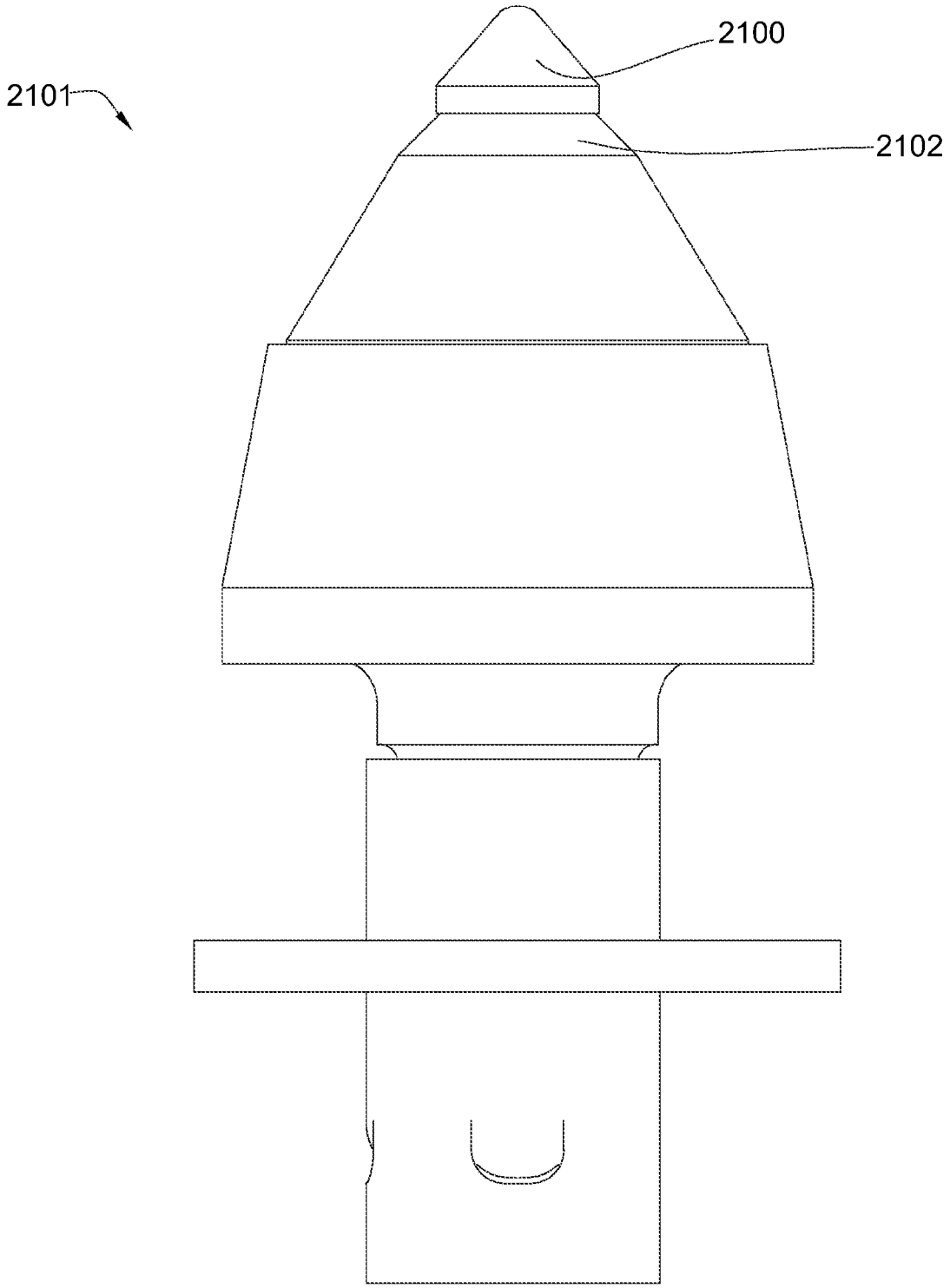
FIG. 21 is an orthogonal view of an embodiment of a road milling pick.

FIG. 21 discloses a high impact tool 2100 attached to an asphalt degradation pick assembly 2101. High impact tool 2100 may be brazed or otherwise attached to a carbide bolster 2102, and the assembly 2101 may be mounted to an asphalt degradation drum or to a mining device.

Figure 22:
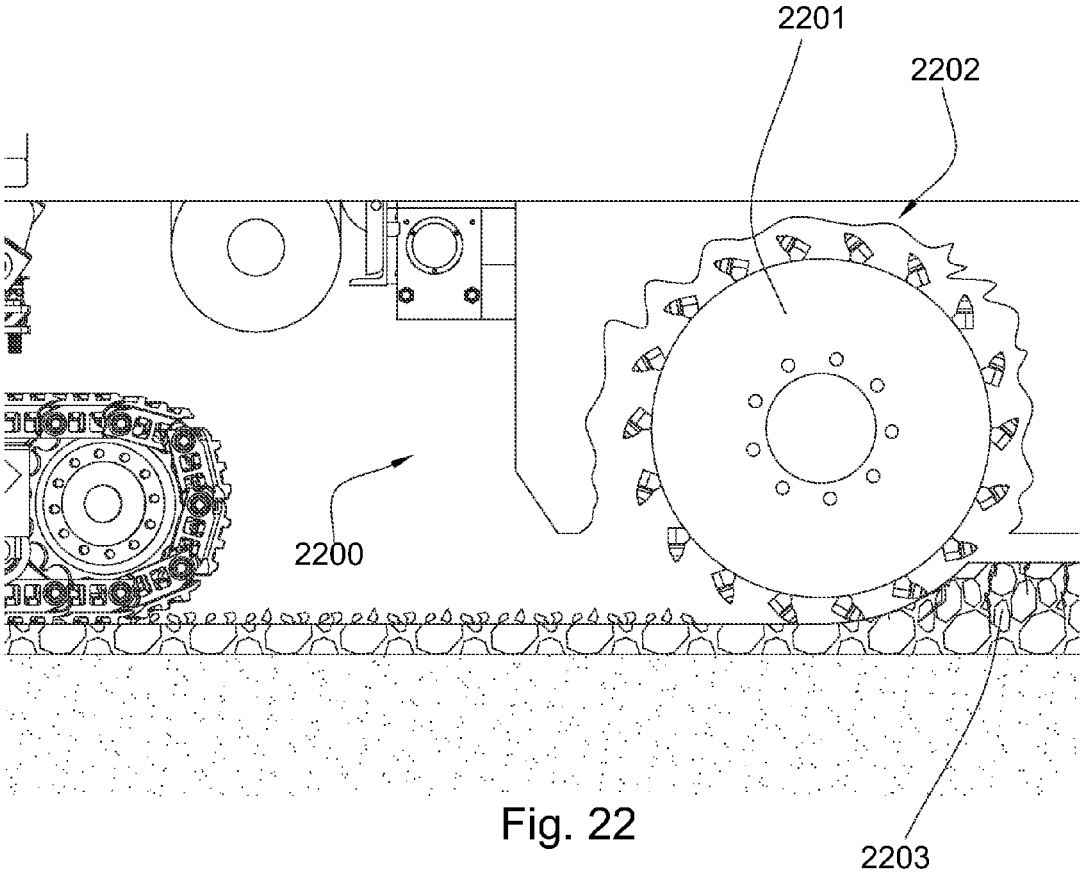
FIG. 22 is an orthogonal view of an embodiment of a pavement degradation machine.

FIG. 22 shows an asphalt degradation machine 2200 comprising an asphalt milling drum 2201. A plurality of high impact tools 2202 are attached to milling drum 2201. The milling drum rotates as the machine advances along a formation 2203, causing the high impact tools to impinge and degrade the formation.

Figure 23:
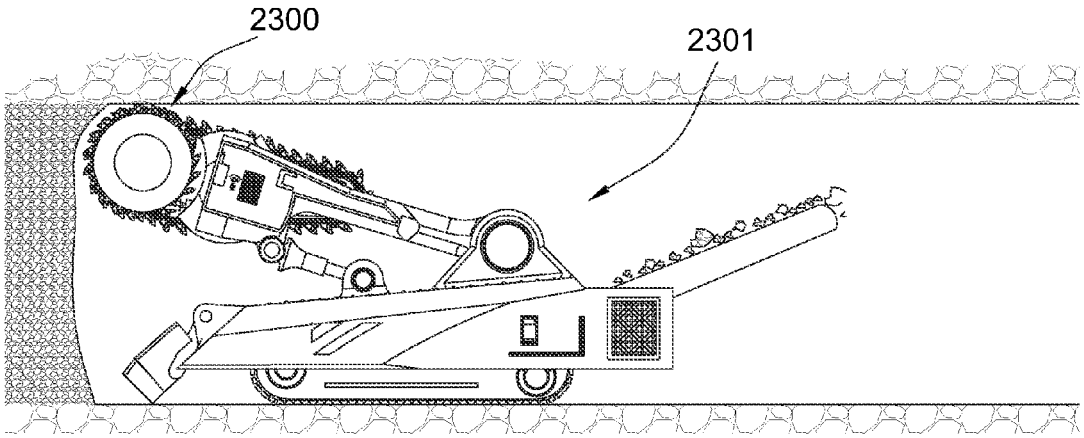
FIG. 23 is an orthogonal view of an embodiment of a mining machine.

FIG. 23 discloses high impact tools 2300 incorporated into a mining machine 2301.

Figure 24:
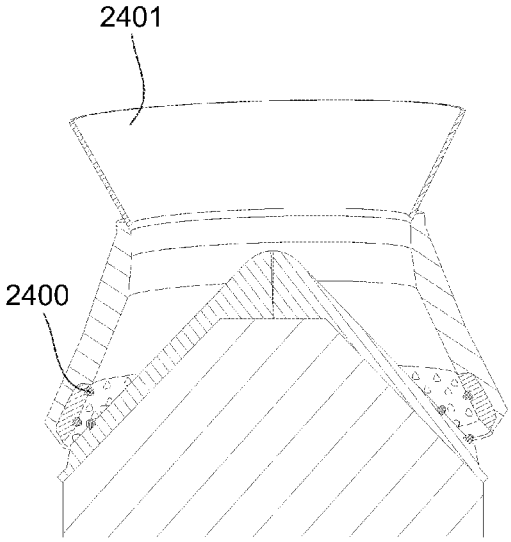
FIG. 24 is an orthogonal view of an embodiment of a cone crusher.

FIG. 24 discloses high impact tools 2400 incorporated into a cone crusher 2401.

Figure 25:
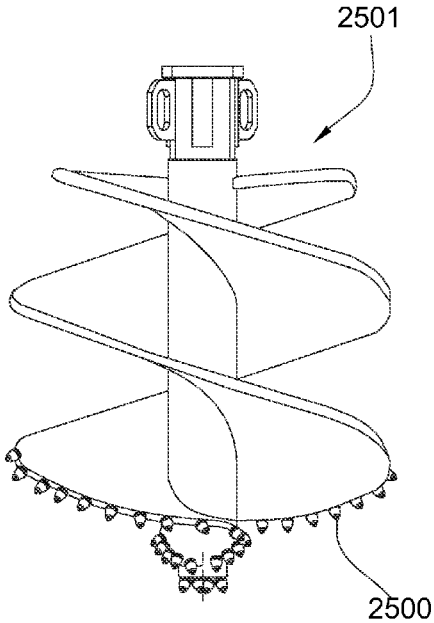
FIG. 25 is an orthogonal view of an embodiment of an auger drilling machine.

FIG. 25 discloses high impact tools 2500 incorporated into a auger drilling assembly 2501.

Figure 26:
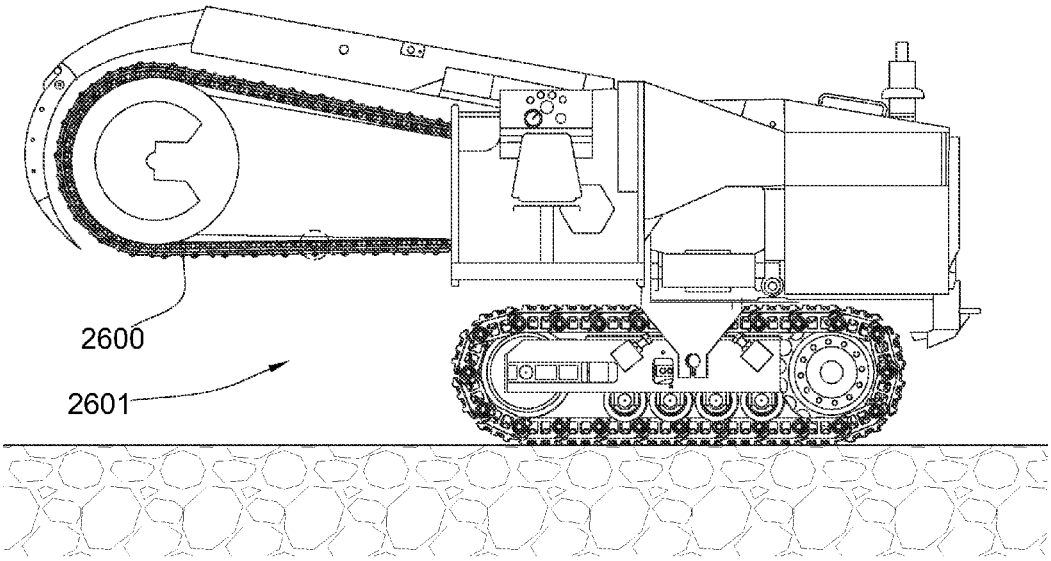
FIG. 26 is an orthogonal view of an embodiment of a trencher.

FIG. 26 discloses high impact tools 2600 incorporated into a mining machine 2601.

Figure 27:
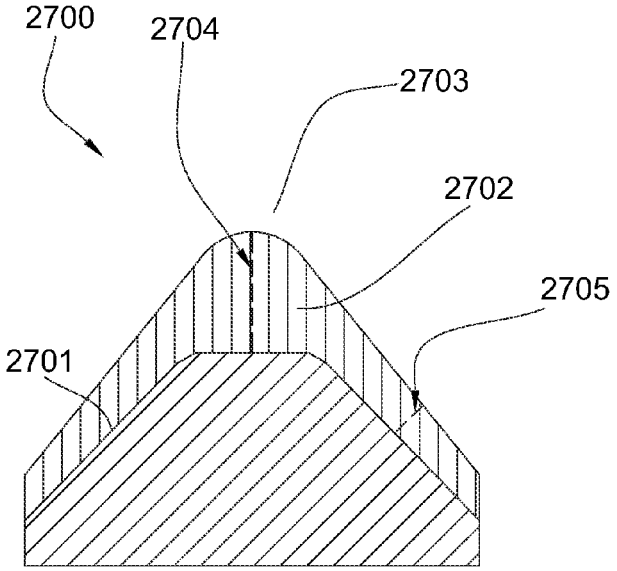
FIG. 27 is a cross-sectional view of another embodiment of a high impact tool.
Figure 28:
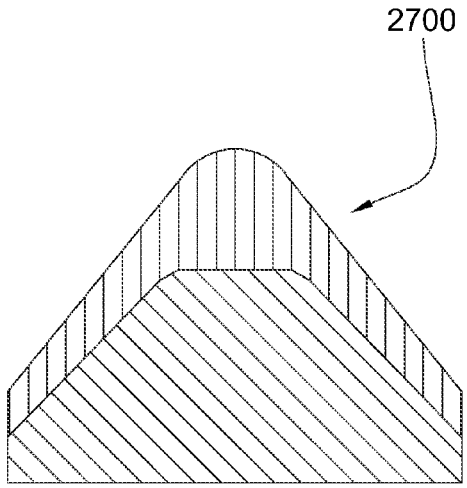
FIG. 28 is a cross-sectional view of another embodiment of a high impact tool.
Figure 29:
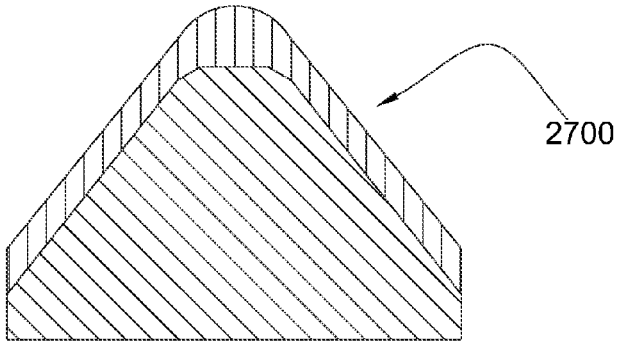
FIG. 29 is a cross-sectional view of another embodiment of a high impact tool.

FIGS. 27-29 disclose high impact tools 2700 with the substrate's taper 2701 covered by a sintered polycrystalline diamond body 2702. The body's thickness along the taper is substantially uniform. However, the body's thickness proximate the body's apex 2703 is greater than along the taper. In some embodiments, the body's apex thickness 2704 is at least twice the taper thickness 2705. In other embodiments, the difference is only a 50% increase. Preferably, the body's apex thickness is sufficient to buttress the diamond when impacts are loaded at the apex.

Whereas the present invention has been described in particular relation to the drawings attached hereto, it should be understood that other and further modifications apart from those shown or suggested herein, may be made within the scope and spirit of the present invention.

What is claimed is:

1. A high impact resistant tool, comprising:

a sintered diamond body bonded to a cemented metal carbide substrate at an interface;

the body comprises a substantially pointed geometry with an apex;

the apex comprising a curved surface that tangentially joins a leading side and a trailing side of the body at a first and second transitions respectively; and an apex width between the first and second transitions is less than a third of a width of the substrate.

2. The tool of claim 1, wherein the body thickness is measured along a central axis of the tool.

3. The tool of claim 2, wherein a tool central axis intersects the apex and the interface.

4. The tool of claim 1, wherein the apex width is a quarter or less than a width of the substrate.

5. The tool of claim 1, wherein the diamond body comprises a volume between 75 and 150 percent of a substrate volume.

6. The tool of claim 1, wherein the curved surface comprises a radius of curvature between 0.050 and 0.110 inches.

7. The tool of claim 1, wherein the curved surface comprises a plurality of curvatures.

8. The tool of claim 1, wherein the curved surface comprises a non-circular curvature.

9. The tool of claim 1, wherein the body comprises a substantially conical shape.

10. The tool of claim 1, wherein the body comprises a substantially pyramidal shape.

11. The tool of claim 1, wherein the body comprises a substantially chisel shape.

12. The tool of claim 1, wherein the body comprises a side which forms a 35 to 55 degree angle with a central axis of the tool.

13. The tool of claim 1, wherein the body comprises a substantially convex side.

14. The tool of claim 1, wherein the body comprises a substantially concave side.

15. The tool of claim 1, wherein at the interface the substrate comprises a tapered surface starting from a cylindrical rim of the substrate and ending at an elevated flatted central region formed in the substrate.

16. The tool of claim 1, wherein the tool comprises the characteristic of withstanding impact greater than 200 joules.

17. The tool of claim 1, wherein the substrate is attached to a drill bit, a percussion drill bit, a roller cone bit, a fixed bladed bit, a milling machine, an indenter, a mining pick, an asphalt pick, a cone crusher, a vertical impact mill, a hammer mill, a jaw crusher, an asphalt bit, a chisel, a trenching machine, or combinations thereof.

18. The drill bit of claim 1, wherein the leading side and trailing side extend smoothly to an outer diameter of the substrate.

19. The drill bit of claim 1, wherein the body also comprises a body thickness from the apex to the interface greater than a third of the width of the substrate.

20. A high impact resistant tool, comprising:

a sintered polycrystalline diamond body bonded to a cemented metal carbide substrate at an interface;

the body comprises a substantially pointed geometry with an apex;

the apex comprising a curved surface that joins a leading side and a trailing side of the body at a first and second transitions respectively; and an apex width between the first and second transitions is less than a third of a width of the substrate;

wherein the leading side and trailing side extend smoothly to an outer diameter of the substrate.

21. The drill bit of claim 20, wherein the at least one high impact tool is attached to the drill bit by interference fit.

22. The drill bit of claim 20, wherein the curved surface tangentially joins the leading side and the trailing side.

23. A High Impact resistant tool, comprising:

a sintered polycrystalline diamond body boned to a cemented metal carbide substrate at an interface;

the body comprises a substantially pointed geometry with an apex;

the apex comprising a curved surface that joins a leading side and a trailing side of the body at a first and second transitions respectively;

an apex width between the first and second transitions is less than a third of a width of the substrate; and the body also comprises a body thickness from the apex to the interface greater than a third of the width of the substrate;

wherein a volume contained by the curved surface comprises less than five percent of catalyzing material by volume, wherein at least 95 percent of the void between polycrystalline diamond grains comprise a catalyzing material.

24. The tool of claim 23, wherein at least 99 percent of the void between polycrystalline diamond grains comprise a catalyzing material.

25. A downhole cutting tool, comprising:

a body having a plurality of fixed blades extending therefrom; and at least one high impact tool attached to one of the plurality of fixed blades, wherein the at least one high impact tool comprises:

a sintered polycrystalline diamond body bonded to a cemented metal carbide substrate at an interface and extending away from the interface to terminate in an apex;

the apex comprising:

a first curved portion and a second curved portion that joins a leading side and a trailing side of the body at a first and second transitions, respectively, and a linear portion spanning between the first curved portion and second curved portion, wherein the linear portion is longer than it is wide.

26. The drill bit of claim 25, wherein the apex is asymmetric.

27. The drill bit of claim 25, wherein the linear portion is angled with respect to a line normal to a central axis of the high impact tool.

28. The drill bit of claim 25, wherein the linear portion is offset from a center of the cemented metal carbide substrate.

29. The drill bit of claim 25, wherein the leading side and trailing side form different angles with respect to an axis normal a surface of the cemented metal carbide substrate and which passes through the apex.

30. The drill bit of claim 25, wherein the at least one high impact tool is attached to the drill bit by interference fit.

31. A downhole cutting tool, comprising:

a body having a plurality of fixed blades extending therefrom; and at least one high impact tool attached to one of the plurality of fixed blades, wherein the at least one high impact tool comprises:

a sintered polycrystalline diamond body bonded to a cemented metal carbide substrate at an interface and extending away from the interface to terminate in an apex;

the apex comprising:

a first curved portion and a second curved portion that joins a leading side and a trailing side of the body at a first and second transitions, respectively, and wherein the leading side and trailing side form different angles with respect to an axis normal a surface of the cemented metal carbide substrate and which passes through the apex.

32. The drill bit of claim 31, wherein the at least one high impact tool is attached to the drill bit by interference fit.

33. A downhole cutting tool, comprising:

a body having a plurality of fixed blades extending therefrom; and at least one high impact tool attached to one of the plurality of fixed blades, wherein the at least one high impact tool comprises:

a sintered polycrystalline diamond body bonded to a cemented metal carbide substrate at an interface and having a sidewall that extends away from the interface to terminate in an apex, wherein the apex tangentially joins the sidewall;

the apex comprising an axis which passes therethrough and which is normal a surface of the cemented metal carbide substrate that is laterally offset from an axis through a center of the cemented metal carbide substrate, the apex having a radius of curvature measured in a vertical orientation from the axis of the apex, the radius of curvature being from about 0.050 to 0.110 inches.

34. The drill bit of claim 33, wherein the at least one high impact tool is attached to the drill bit by interference fit.

35. A downhole cutting tool, comprising:

a body having a plurality of fixed blades extending therefrom; and at least one high impact tool attached to one of the plurality of fixed blades, wherein the at least one high impact tool comprises:

a sintered polycrystalline diamond body bonded to a cemented metal carbide substrate at an interface and extending away from the interface to terminate in two apexes, each apex having a radius of curvature and an axis which passes therethrough which is normal a surface of the cemented metal carbide substrate, each apex having a radius of curvature measured in a vertical orientation from their respective axis, each radius of curvature being from about 0.050 to 0.110 inches, and the first apex being proximate a leading side of the body and the second apex being proximate a trailing side of the body.

36. The drill bit of claim 35, wherein the radius of curvature of each of the two apexes is the same.

37. The drill bit of claim 35, wherein the two apexes have unequal radii of curvature.

38. The drill bit of claim 35, wherein the two apexes are at the same axial height.

39. The drill bit of claim 35, wherein the two apexes are at differing axial heights.

40. The drill bit of claim 35, wherein the at least one high impact tool is attached to the drill bit by interference fit.

* * * * *